US005652983A

United States Patent [19]

Kraemer

[11] Patent Number: 5,652,983

[45] Date of Patent: Aug. 5, 1997

[54] SIT/SLEEP CONSTRUCTED PILLOW

[76] Inventor: John A. Kraemer, 1410 Riverview Dr., Stillwater, Minn. 55082

[21] Appl. No.: 383,711

[22] Filed: Feb. 3, 1995

[51] Int. Cl.[6] ..... A47C 20/02

[52] U.S. Cl. ..... 5/639; 5/630; 5/636; 5/645

[58] Field of Search ..... 5/636, 417, 419, 5/490, 485

[56] References Cited

U.S. PATENT DOCUMENTS

| | | | |
|---|---|---|---|
| 1,925,358 | 9/1933 | Wittcoff | 5/485 |
| 2,183,418 | 12/1939 | Williams | 5/636 |
| 2,412,769 | 12/1946 | Easterbrooks | 5/636 |
| 2,895,146 | 7/1959 | Lester | 5/490 |
| 3,044,517 | 7/1962 | Levi | 5/490 |
| 4,768,245 | 9/1988 | Dutton | 5/636 |
| 5,172,440 | 12/1992 | Ming | 5/417 |
| 5,271,114 | 12/1993 | Kjersem | 5/636 |

*Primary Examiner*—Steven N. Meyers
*Assistant Examiner*—Tuyet-Phuong Pham

[57] ABSTRACT

The Sit/Sleep Constructed Pillow provides multiple uses in functioning as a sitting pillow that transforms into a sleeping pillow while providing an envelope that forms a self contained enclosure for compression and stowage. The Sit/Sleep Constructed Pillow is fabricated from one length of material that encloses the pillow loft and forms an envelope that is used along with fasteners to reduce the perimeter dimensions of the pillow for sitting purposes that in turn transforms into a larger dimensioned sleep pillow with a separate fabric head rest and cover while providing an enclosure for compression and stowage of the pillow, an enclosure that can also be used for stowage when not used for pillow compression.

3 Claims, 2 Drawing Sheets

SITTING PILLOW

SIT/SLEEP PILLOW

CONSTRUCTED INSIDE OUT

TURNED RIGHT SIDE OUT

SITTING PILLOW

SLEEPING PILLOW

SIT/SLEEP CONSTRUCTED PILLOW

SUMMARY OF INVENTION

The present invention provides for convenient pillow sitting, pillow head rest and pillow head cover, and self contained stowage for all seasons and environmental conditions by readily transforming from a smaller dimensioned, high lofted sitting pillow to a larger dimensioned, lower lofted sleeping pillow with a reversible and stretchable head rest and cover and a self contained enclosure for pillow compression and stowage. There are presently no known sit or sleep pillows that provide the multiple use options for sitting and sleep use while providing a self contained enclosure for convenient compression and stowage of the pillow.

OPERATION OF INVENTION

Figure 1:
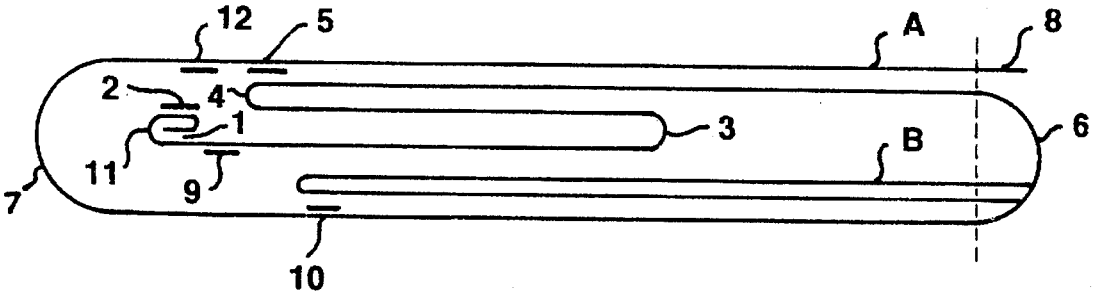
FIG. 1 is a side view of the sit/sleep pillow in cross section illustrating the positioning of folds and relative lengths of material enclosing the pillow and forming the sit/sleep pillow before the pillow is turned right side out.

The Sit/Sleep Pillow is opened by releasing fasteners that secure the compressed pillow loft to the lesser volume of a self contained stowage enclosure. The enclosure that confines the pillow and forms the stowage enclosure transforms into a sitting pillow by release of stowage fasteners and attachment of fasteners to compatible fasteners secured to the loft enclosure.

To transform the pillow from the sitting to sleep pillow mode, the envelope is moved to the opposite side of the pillow from the fabric head rest and cover thus exposing the fabric head rest and cover. The head can be rested on the fabric head rest and cover or placed beneath the fabric and worn like a hat. Also the head rest and cover can be reversed to the opposite side of the pillow to expose the opposite side of the folded fabric should the exposed side be wet and soiled. The head rest and cover and the enclosure can be pulled over one end of the pillow to achieve the desired configuration. The head rest and cover fabric is typically a folded thickness of fleece material with lateral stretch in the direction of the fold. With the enclosure positioned over the pillow, the enclosure can be utilized along with the attendant parallel fasteners to compress the pillow into and secure the pillow in the formed enclosure. With the enclosure to one side of the pillow, the fasteners secured enclosure can also be used for stowage in the sleeping pillow mode.

DESCRIPTION OF INVENTION

The Sit/Sleep Pillow consists of a continuous length of fabric which encloses bedding loft material commonly used for head resting pillows. The material enclosing the typically square or rectangular pillow shape is a continuous length and typically water repellent and extends beyond the pillow enclosure to form an enclosure which can be positioned on either or both sides of the pillow to cover or expose the head rest and cover. The head rest and cover is typically polyester fleece that is folded and stretchable in the direction of the fold and secured to the remaining three sides of the pillow. The folded edges of the enclosure typically have nylon fasteners that allow the enclosure to be secured for pillow compression and stowage. There are also fasteners attached to the material that encloses the pillow loft and a compatible fastener attached to the enclosure for use in forming the smaller dimension sitting pillow. The enclosure is deep enough to cover and thereby protect the fabric head rest and cover in the sitting mode, to accommodate the pillow when compressed, as well as provide a secure pouch for stowage. The pillow loft enclosure is approximately ½ the overall length of the continuous fabric material. The folded head rest and cover is approximately ¾ths the length of the unattached side of the pillow; the thickness of stretchable fleece material that provides the head rest and cover is approximately ⅛th the average thickness of the pillow.

DESCRIPTION OF PREFERRED EMBODIMENT

Other objects and attendant advantages will be appreciated by those skilled in this art as the invention becomes better understood by reference to the accompanying drawings, in which FIGS. 1–4 are provided with references to identified features.

FIG. 1 illustrates a side view of the Sit/Sleep Pillow in cross section and illustrates the positioning of folds and relative lengths of material enclosing the pillow and forming the Sit/Sleep Constructed Pillow before the pillow is turned right side out. In FIG. 1, one end of the continuous length (1) of the material (A) enclosing the pillow loft and forming the pillow is folded twice at right angles to the length of the material at the end (1) of the material (A) and secured with a nylon fastener (2) centered, positioned and sewn through the double folds along the leading edge of the folded material. From the folded end (11), the material (A) runs a length determined by the compressibility of the loft material and then folds back on itself (3) and extends back to the folded end (1) where it makes another same direction fold (4) thus forming and enclosure between folds (1) and (4) with fastener (5) sewn through fold (4), compatible to the end edge fastener (2). The continuous material (A) then runs to the opposite end of the pillow (6) and then runs the length of the pillow to (7) to fold and run to the far end of the pillow (8) where the end of the continuous material (A) is sewn through the end material (8), sewn through the fold (6) and sewn through the two ends of the folded fleece material or equivalent (B) that is positioned underneath all the internal folds and abutted to fold (6). Fastener (9) is positioned on the opposite side of the envelope from fastener (2) of the folded end (11). For sitting pillow use, fastener (10) and (12) are inturn secured to the material that encloses the pillow loft and are compatible with fasteners (2) and (9) respectively.

Figure 2:
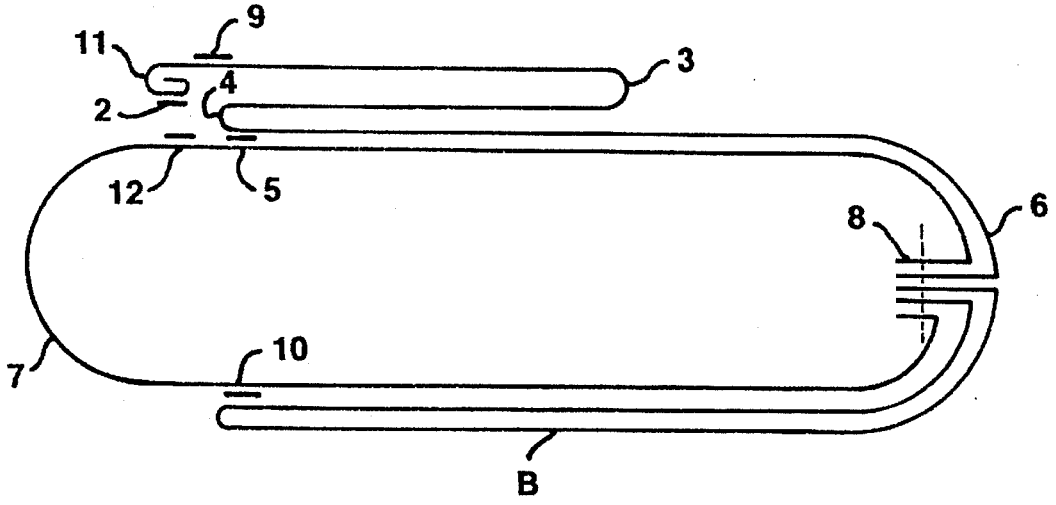
FIG. 2 is a side view of the sit/sleep pillow in cross section illustrating the positioning and relative lengths of the material enclosing the pillow loft after the pillow is turned right side out.

FIG. 2 illustrates a side view of the Sit/Sleep Pillow in cross section to illustrate the positioning and relative lengths of the material enclosing the pillow loft and forming the Sit/Sleep Constructed Pillow after the pillow is turned right side out. In FIG. 2, the end (11 ) of the continuous length of material (A) is external to the pillow and along with the enclosure formed by folds (3) and (4) can accommodate the larger volume of the pillow loft when (11 ) is pulled back and over the end of the pillow (8) and over the folded fleece material or equivalent and the pillow is compressed into the enclosure formed by end (11) and folds (3) and (4) and secured with fasteners (2) and (5). To form a sitting pillow, the envelope (formed by 11,3, and 4) is pulled over the fleeced end of the pillow and fastener (9) is attached to fastener (10) and fastener (12) is attached to fastener (5).

Figure 3:
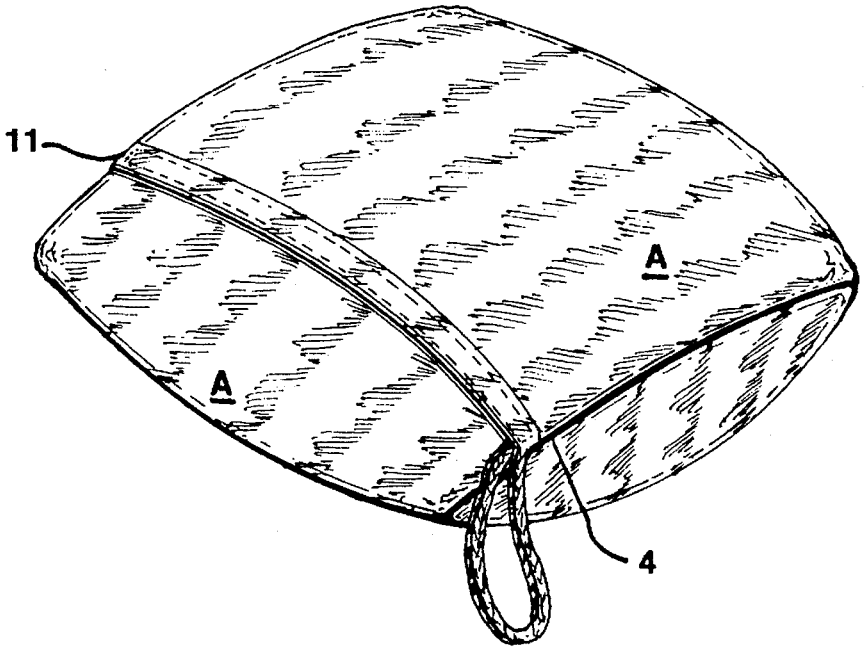
FIG. 3 is a perspective view of the pillow showing the fabric head rest and cover.

FIG. 3 illustrates a perspective view of the pillow in the position where the pillow fabric head rest and cover as covered by the enclosure, which would be the typical position for sitting and outdoor use. In the sitting pillow mode, only the continuous external water repellent material (A) is exposed and the folded fleece material or equivalent is covered by end (11) with the opposite side of the pillow covered by 2 thicknesses of the continuous material (A) formed from fold (4).

Figure 4:
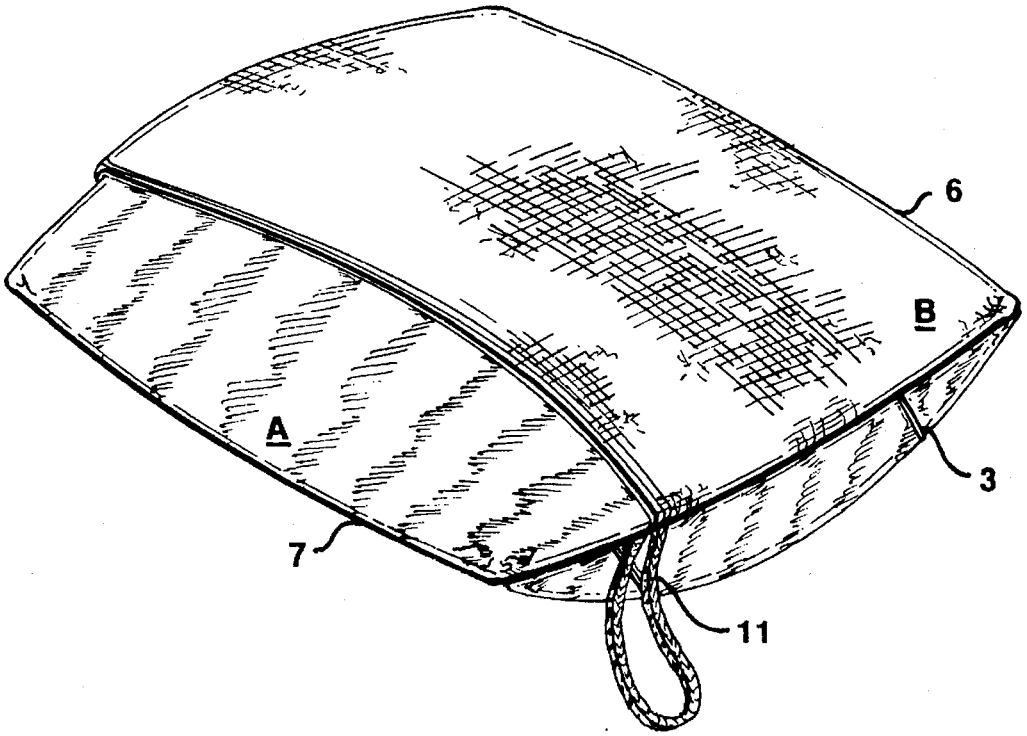
FIG. 4 is a perspective view of the pillow with the head rest and cover in position and the stowage envelope on the opposite side of the pillow.

FIG. 4 illustrates a perspective view of the pillow with the fabric head rest and cover in position and the stowage envelope on the opposite side of the pillow. In FIG. 4, the head rest and cover (B) is exposed with end (11) and the fold (3) and (4), which comprise the enclosure for the pillow on the opposite end of the pillow and not in view. When using the fleece material or equivalent as a head cover, the end (11) and/or folded envelope (3) that can not be seen can be pulled over the end of the pillow as to provide additional wind and warmth protection for the head.

I claim:

1. An adjustable pillow comprising:

a continuous length of a first sheet of material folded to form a folded edge and secured together along three side edges forming a pillow loft enclosure having upper and lower opposed surfaces with pillow fill positioned there between, said pillow loft enclosure having a length, a width and a thickness, a continuous extension of said first sheet of material having a length longer than the length of said loft enclosure and secured to said upper surface at a side edge opposite said folded edge and sewn to the two side edges perpendicular to the folded edge forming a first envelope having an open end opening in one direction and having a length less than the length of said loft enclosure, a second extension of said first sheet of material secured to the open end of said first envelope wherein said second extension is folded in one direction over said first envelope to create a second folded edge and said second extension is folded a second time in an opposite direction over said first envelope to form a second envelope having an open end opening in the same direction as said first envelope and having a length less than the length of said first envelope with said second extension secured to the side edges perpendicular to the second folded edge, a first fastener secured to one surface of the open end of said first envelope and a second fastener secured to one surface of the open end of said second envelope wherein said first and second fasteners matingly engage each other to form a closure, a third fastener secured to a surface opposite said one surface of said first envelope and a fourth fastener secured to said one surface of said second envelope, a second sheet of fleece-type material folded in half and secured to said lower surface of said loft enclosure along three unfolded side edges forming a pillow rest and cover opening towards one side of said loft enclosure and having a length less than the length of said loft enclosure, wherein the pillow can be compressed into said second envelope by pulling the open end of said first envelope over the pillow towards a direction opposite the opening direction of said first envelope to expose said second envelope and pulling the open end of said second envelope over the pillow towards a direction opposite the opening direction of said second envelope and securing said third and fourth fasteners together.

2. The adjustable pillow of claim 1 wherein said pillow loft enclosure is ½ the length of said first sheet of material and said second sheet of folded material is approximately ¾ the length of said pillow loft enclosure.

3. The adjustable pillow of claim 1 wherein said pillow rest and cover has a thickness ⅛ the thickness of the pillow loft enclosure and is secured to said continuous first sheet of material so as to leave the folded side unsewn so that said second sheet of material can be reversed to an opposite side of the pillow loft enclosure to expose an unsoiled side and/or allow the sheet of material to dry.

* * * * *